US005638757A

United States Patent [19]

Cortesi

[11] Patent Number: 5,638,757

[45] Date of Patent: Jun. 17, 1997

[54] RAIL VEHICLE AND TRUCK FOR SUCH A VEHICLE

[75] Inventor: Alberto Cortesi, Gachnang, Switzerland

[73] Assignee: SLM Schweizerische Lokomotiv- und Maschinenfabrik AG, Winterthur, Switzerland

[21] Appl. No.: 729,198

[22] Filed: Oct. 15, 1996

Related U.S. Application Data

[63] Continuation of Ser. No. 326,102, Oct. 19, 1994, abandoned.

[30] Foreign Application Priority Data

Oct. 21, 1993 [CH] Switzerland ..... 03169/93

[51] Int. Cl.[6] ..... B61F 5/38

[52] U.S. Cl. ..... 105/168; 105/199.1

[58] Field of Search ..... 105/4.1, 165, 168, 105/199.1

[56] References Cited

U.S. PATENT DOCUMENTS

| | | | |
|---|---|---|---|
| 1,003,277 | 9/1911 | Lincoln | 105/168 |
| 3,974,779 | 8/1976 | Lindblom et al. | 105/165 |
| 4,362,109 | 12/1982 | Panagin | 105/199.1 |
| 5,335,602 | 8/1994 | Richter et al. | 105/168 |

FOREIGN PATENT DOCUMENTS

| | | |
|---|---|---|
| 0025409 | 3/1981 | European Pat. Off. . |
| 0144780 | 6/1985 | European Pat. Off. . |
| 271690 | 11/1987 | European Pat. Off. . |
| 0277929 | 8/1988 | European Pat. Off. . |
| 0295462 | 12/1988 | European Pat. Off. . |
| 0357951 | 3/1990 | European Pat. Off. . |
| 420801 | 9/1990 | European Pat. Off. . |

OTHER PUBLICATIONS

Müller–Hellmann, Adolf, "Niederflurbauweise stimuliert die Entwicklung neuer Fahrwerks–und Antriebstechnologien für Nahverkehrsschienenfahrzeuge", in: EB Elektrische Bahnen 89 (1991), No. 6, 178–185.

*Primary Examiner*—S. Joseph Morano

*Attorney, Agent, or Firm*—Townsend and Townsend and Crew LLP

[57] ABSTRACT

The rail vehicle has at least one truck (1) with two wheelset units (12, 12') which are hingedly connected to one another via a coupling arrangement. This truck (1) is formed as a frameless support arrangement and the vehicle body (17) is supported on spring elements (10) and has at least one guide device or at least one pendulum (11) between the truck (1) and the vehicle body (17). The design is greatly simplified by the omission of the complicated bogie frame and is thus light and compact. The radially adjustable wheelset units (12, 12') can moreover be arranged with a small spacing from one another. The frameless truck (1) is accordingly particularly well suited for rail vehicles on rail networks which have narrow turning radii.

16 Claims, 4 Drawing Sheets

Fig.3
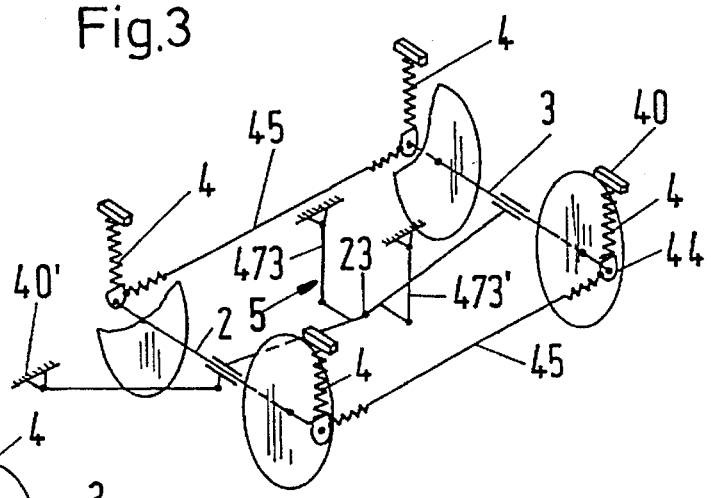
Fig.2
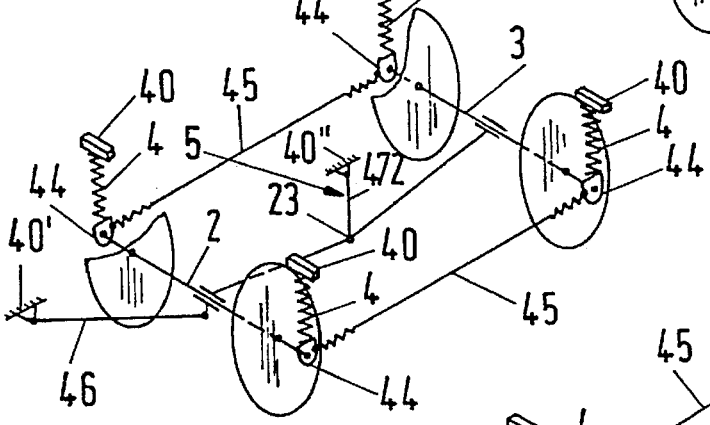
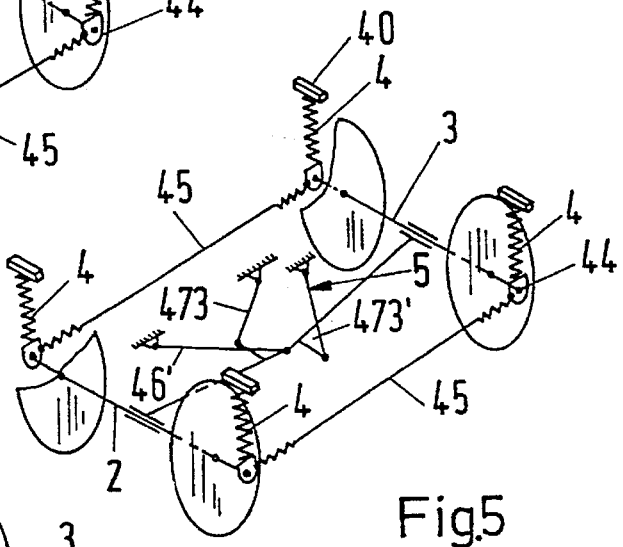
Fig.5
Fig.4
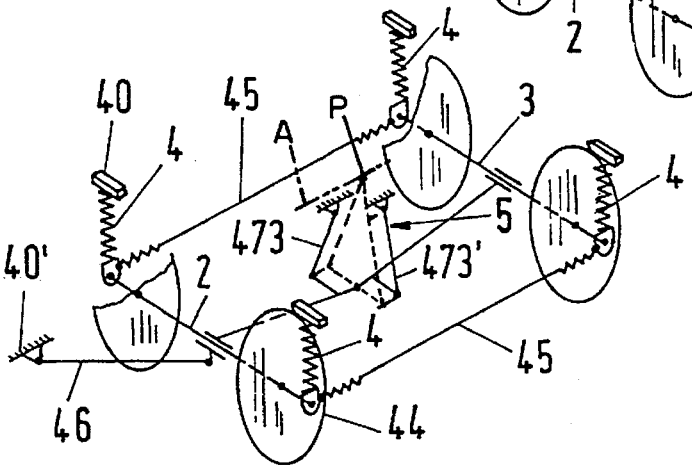

RAIL VEHICLE AND TRUCK FOR SUCH A VEHICLE

This is a continuation of U.S. patent application Ser. No. 08/326,102, filed Oct. 19, 1994 now abandoned, the disclosure of which is incorporated by reference.

BACKGROUND OF THE INVENTION

The invention relates to a rail vehicle which has at least one truck with two wheel units hingedly coupled to each other.

Both rail traction vehicles and also carriages of the named kind consist essentially of a vehicle body which is built up on one or more bogies and is carried by the latter. The wheelsets or axle units are built into the frame of the bogie. The wheelsets are mutually movably arranged in some of these bogies in order to improve the characteristics when travelling around curves.

Independently of whether one is concerned with simple running wheelsets or with driving wheelsets driven by motors, the wheelset units have hitherto been arranged in a frame construction on which the vehicle body is resiliently supported. Such trucks with so-called nose suspension units which are journalled in a frame and pivotable with respect to each other are known and their function is for example described in detail in EP-A1-0 420 801.

Such bogies or trucks with the traditional frame construction are relatively complicated, expensive and heavy, in particular from the point of view of fabrication. The design is particularly complicated for rail vehicles for permanent ways and rail networks with relatively small radii of curvature, since the relatively short spring stages between the wheelset units and the frame construction must accommodate large relative movements in the horizontal plane with radial adjustment of the wheelset units.

SUMMARY OF THE INVENTION

It is an object of the invention to provide a truck for rail vehicles, and thus a rail vehicle, which can be manufactured with less complexity and cost, which is lighter than previous embodiments, and in which the wheelsets of a truck permit automatic radial adjustment for even small radii of curvature of the rails.

In accordance with the invention this object is attained with a rail vehicle having at least one truck formed as a frameless support for the vehicle body and spring elements as well as at least one guide which are arranged between the body and the truck.

The new truck is no longer a traditional bogie in which the axles are journalled in a chassis or frame. Its simplified design brings a saving of weight and above all a large saving in cost. Moreover, it enables an automatic radial adjustment of the axles over a relatively large angular range. This in turn has the consequence that the angle of attack of the wheels remains small even with small radii of curvature of less than 300 m. This keeps the rail and wheel wear low because transverse and longitudinal slippage is greatly reduced. At the same time the typical squeaking noises which occur when travelling around tight curves with conventional bogies are avoided. The proposed design is in particular advantageous for, for example, articulated rail cars in which the traction unit is arranged as a separate unit between two carriage parts.

Trucks in accordance with the invention and the connection hinge between the two axle units adjust automatically practically unaffected to the radius of curvature, even under the action of pulling or braking forces. For the transmission of these traction forces (longitudinal forces) the vehicle body can be coupled with one of the wheelset units via a push-pull rod which is so arranged that the extension of its axis meets the plane of the upper edges of the rails beneath the connection hinge between the two wheelset units. Accordingly, a situation is achieved in which no axle load differences between the two axle units arise under the action of the tractive forces.

The new truck of the invention however also permits a very compact manner of construction with a minimum axle base and simultaneously good accessibility for servicing work, since the actual frame structure of previous bogies is missing.

Thus, the need for a bogie frame, which supports the vehicle body and has a complex structure, has been eliminated by a truck made in accordance with the invention. In its place the support arrangement of the invention requires essentially only springs, which can have long strokes and are preferably supported directly on the axle bearings, a guide device or a pendulum arrangement, as well as means for the transmission of longitudinally oriented forces which act between the vehicle body and the wheelsets. In a preferred embodiment the pendulum between the truck and the vehicle body is a spherically journalled space pendulum which permits universal relative movements; that is, movements between the wheelset unit and the vehicle body.

The present invention provides the truck with a large torsional softness of the axles in comparison to a bogie with a customary rigid frame so that essentially balanced wheel loads can be achieved if even, for example, track distortions are encountered. Thus the present invention significantly reduces the danger of derailling due to a poor track bed.

In a design with for example two pendulums, the rolling stiffness between the truck and the vehicle body can be determined by the choice of the spacing in the transverse direction of the vehicle and also by the stiffness of the pendulum and its fastening eyes. With a pendulum arrangement with inclined pendulums, the position of the roll center can moreover be influenced. It can, for example, be selected so that it lies approximately at the body level of the passengers. In this way the comfort conditions for the passenger can be improved.

Connecting rods can be provided at one or both sides, for example between the axle bearing housings of the wheelsets, for the resetting of the wheelset units which are pivoted in the opposite sense about the vertical vehicle axis. The resetting can take place passively with push-pull springs or also actively with the aid of pneumatic or hydraulic cylinders, positioning motors, etc. In the latter case the pivoting of the wheelset units can also be controlled, regulated or blocked in accordance with preset values.

Moreover, pressure springs, tension springs or push-pull springs can be arranged between the wheelset units or, with driven axles with nose suspension units, between the drive units. In order to improve the characteristics which determine the running stability, for example, for the damping of oscillations in the upper speed regions, the twisting movement can also be damped by dampers which are for example arranged parallel to the resetting springs. The formation of the resetting springs as rubber springs which can have inherent damping characteristics is particularly advantageous. The resetting can also be achieved in that the connection hinge between the wheelset units is made stiff against outward turning and generates the resetting forces during deflection. Other design possibilities can for example also consist in the springs between the vehicle body and the truck being made transversely stiff in the longitudinal direction or in the direction of travel.

So-called FLEXICOIL springs of known design are for example used for the transverse guidance of the vehicle body. Other possibilities for the transverse guidance are for example laterally resilient boundaries above one or both axles. It is also possible to arrange a transverse stiffener inside the springs or to mount transverse buffers between the connecting rods of the wheelsets and side cheeks of the boxcar. The possibility; however, also exists of generating a resetting force with the aid of the pendulum, or of the pendulums, if, for example, the pendulum is made short and/or is secured at one or both sides to rubber hinges which generate the resetting moments on deflection. Through suitable matching of the transverse springing of the box and the resetting forces of the pendulum arrangement in the transverse direction of the vehicle, a situation can also be achieved in which the centrifugal force which arises during travel around a curve assists the radial setting of the wheelsets.

Instead of using a pendulum arrangement a different guide device, for example in the form of a spherical hinge connection between one of the wheelset units and the vehicle body, or in the form of a resilient connection, for example by means of an intermediate piece or a rubber-like material, can be provided, so that the longitudinal forces can also be transmitted.

In accordance with a further embodiment a part of the wheelset units or of the connection hinge arranged between the latter can be movably supported transverse to the direction of travel on a guide track arranged at the vehicle body. In accordance with another embodiment the wheelset units can be braced against each other via a self-supporting arrangement arranged independently from the vehicle body at a distance from the connection hinge, for example above the latter, so that the connection parts which are provided for the transmission of the longitudinal forces are freely deflectable in the transverse direction. A corresponding support arrangement is for example known from FIG. 8 of the initially named EP-A-0 420 801.

In order to favor the outward turning movement between the truck and the vehicle body when travelling around a curve, which improves the running of the truck around curves, tilting rubber rails or other spring supports can for example be used which favor a tilting of the springs preferably in one direction. Tilting rubber rails which are centered transverse to the direction of travel, or relative to the center of rotation of the truck, are for example known from EP-A-0 271 690.

In the following the invention will be explained in more detail with reference to figures which show schematic examples of the invention and details.

BRIEF DESCRIPTION OF THE DRAWINGS

FIG. 1*a* is a fragmentary, side elevational view which illustrates the use of air springs in accordance with the present invention;

FIG. 2 is an outline illustration of a truck with a pendulum;

FIG. 3 is an outline illustration of a truck with two pendulums arranged in parallel;

FIG. 4 is an outline illustration of a truck having two inclined pendulums with a roll center in the vehicle body;

FIG. 5 is an outline illustration of a truck with inclined pendulums with a roll center in the vehicle body and in which a push-pull rod engages between the wheelsets in the region of the coupling;

DESCRIPTION OF THE PREFERRED EMBODIMENTS

Figure 1:
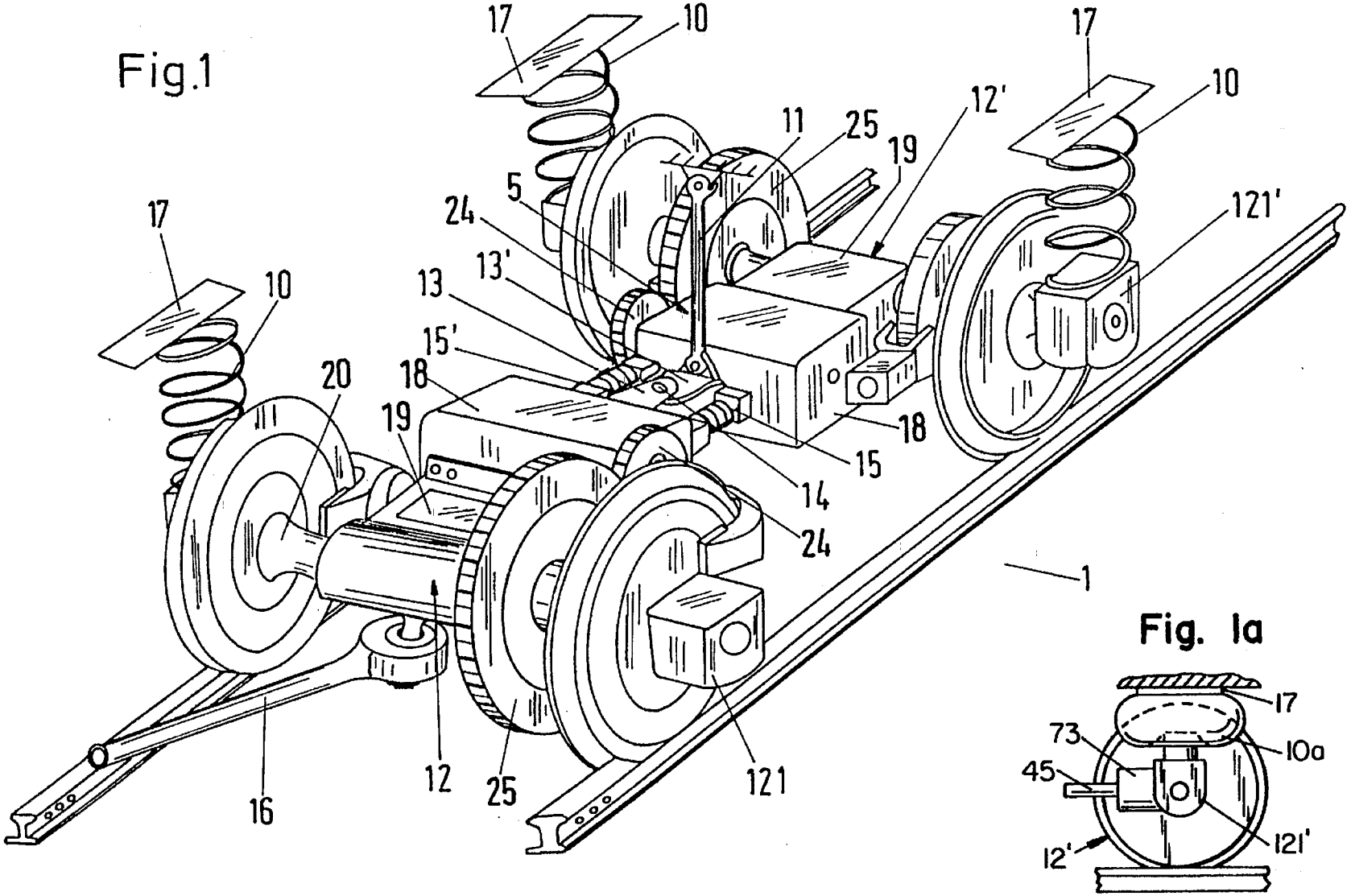
FIG. 1 a truck with two wheelsets for a rail vehicle formed as nose suspension units.

FIG. 1 shows a truck 1 of a rail vehicle made in accordance with the invention, the truck being formed as a frameless support arrangement and in which the vehicle body which is supported on the springs 10 (or airsprings 10*a*, see FIG. 1*a*) is only indicated briefly in the drawing by the parallelograms 17. The springs 10 are supported at the truck side on the axle bearings 121 and 121' of wheelset units 12 and 12' which are formed as driving wheelsets. These each contain a drive motor 18 which is supported via nose suspension 19 on the axle 20 of the related wheelset and is transmittingly coupled with the axle via gear wheels 24 and 25. The two wheelset units 12 and 12' are hingedly connected together via the hitches 13, 13' and the coupling 14 and are coupled to the vehicle body via a guide device 5 in the form of a pendulum arrangement which, in accordance with the illustration, contains a pendulum 11 hinged to the wheelset unit 12' and to the vehicle body.

The two resetting spring elements 15 and 15' are arranged between the two wheelset units 12 and 12'. The push-pull bar 16 is mounted between the wheelset unit 12 and the vehicle body which is only indicated by the parallelograms 17 and essentially serves to transmit the traction forces between the vehicle body and the truck 1. The pendulum 11 serves on the one hand for the suspension of the wheelset units 12, 12' and, on the other hand, also for torque support or stabilization under traction forces.

In the outline illustrations of FIGS. 2 to 5 the two wheelset units 2 and 3 of the frameless truck 1 of the invention are shown as well as spring elements 4 which are supported on the axle bearings 44 and support the vehicle body which is only symbolically indicated by the blocks 40. The blocks 40 are formed by rail-like support pieces of rubber or of a corresponding rubber-like material which are arranged in known manner transverse to the direction of travel. Resetting elements 45 hinged to the wheel bearings 44 are arranged between the wheelset units 2 and 3 of each truck. The push-pull rod 46 is mounted in each case between one wheelset unit 2 and the mounting position 40' on the vehicle body.

The trucks of FIGS. 2 to 4 are distinguished by the arrangement of the pendulums which are arranged between the truck and the vehicle body.

In FIG. 2 the single pendulum 472 is pivotally connected to the hitches at the truck side in the region of the coupling 23 of the two wheelset units 2, 3 and is led to the mounting position 40".

In the truck of FIG. 3 two pendulums 473, 473' are present which can advantageously be executed with resilient hinges. Each of these pendulums is connected to one of the wheelset units 2, 3 of the truck and leads to the vehicle body. The pendulums are arranged in parallel.

In contrast, the two pendulums 473, 473' of the truck arrangements of FIGS. 4 and 5 are arranged inclined to one another. Their projections onto a plane perpendicular to the direction of travel intersect at a level in the vehicle body (not shown), at the so-called roll center, an ideal pivot point "P". With a vehicle having, for example, two truck arrangements, these roll centers form a roll axis for the vehicle which extends through the two roll centers of the two truck arrangements.

The push-pull rod of the running gear of FIG. 5 is mounted between the coupling regions of the wheelsets 2, 3 and the vehicle body.

Figure 6:
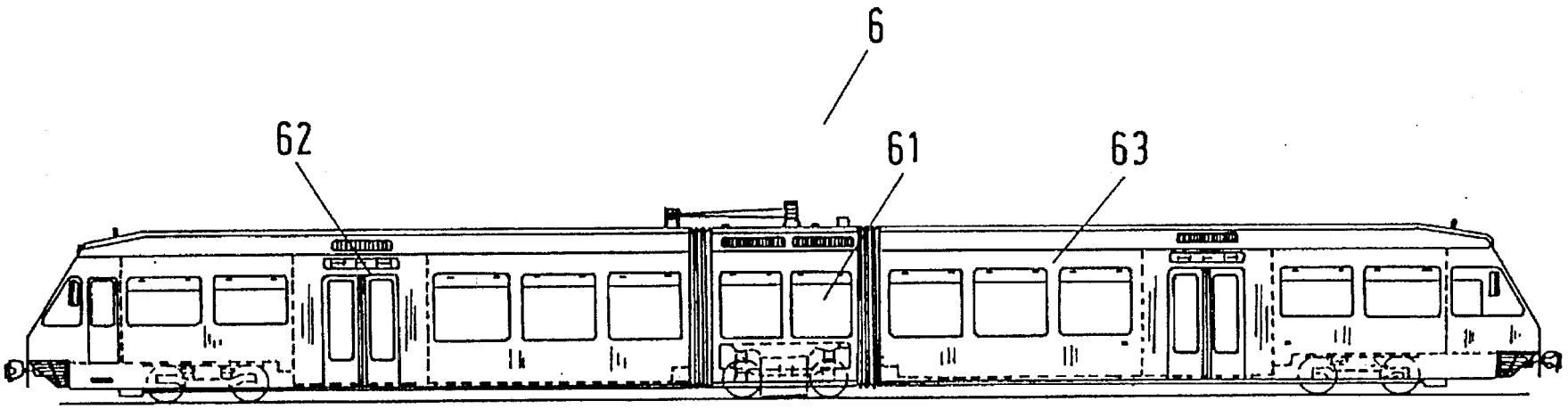
FIG. 6 is a side view of an articulated rail car with a central drive unit.

With the three-part articulated drive car 6 of FIG. 6 the drive unit 61 is formed as a compact vehicle part with a truck. The central drive unit 61 can for example be hingedly connected to the two other vehicle units 62 and 63 via pivot pins, pendulum suspension and/or in each case via a lemniscate guide of known construction.

Figure 7:
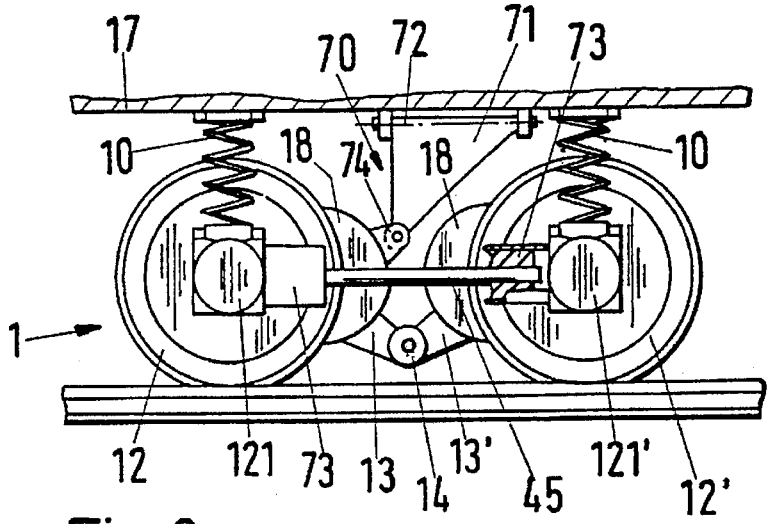
FIG. 7 is a side view of a truck in a modified embodiment.

The truck 1 of FIG. 7 is coupled to the vehicle body 17 via a guide device 70 which contains a guide part projecting from the vehicle body 17 in the form of a bracket 71. The bracket 71 is pivotally mounted in hinge-like manner to the vehicle body 17, as part of pendulum arrangement, about an axis 72 which extends in the longitudinal direction of the vehicle and is hingedly connected to the wheelset unit 12. In accordance with the illustration the bracket 71 is connected to the drive motor 18 via a ball joint 74 so that it is movable in space. In this embodiment the resetting elements 45 are pivotally connected to the axle bearings 121, 121' via spring elements 73 which, in accordance with the illustration, can each comprise a rubber-like material and through which undesired oscillations of the wheelset units 12, 12' can be damped and thus the running stability of the truck 1 can be improved. The bracket 71 serves, on the one hand, to guide the wheelset units 12, 12' in the transverse direction of the vehicle and, on the other hand, as a means for transmitting the traction forces between the truck and the vehicle body 17. Corresponding resetting forces can be transmitted to the wheelset units 12 and 12' which adjust themselves approximately radially when travelling around a curve, via the brackets 71 which are connected in hinge-like manner to the vehicle body 17, and these resetting forces counteract the respective oppositely directed deflections of the wheelsets.

In deviation from the illustrated embodiment the guide device 70 can also contain a fixed co-moving or follower part corresponding to the bracket 71 and mountable on or formed on the vehicle body 17 which is spatially movably coupled with one of the wheelset units 12, 12' via the described hinge connection and/or a corresponding resilient connection. The co-moving part can for example be executed in the form of a vertical pivot or contain such an element. A corresponding co-moving part can also be mounted on one of the wheelset units 12, 12' and can be coupled to the vehicle body 17 for spatial movement.

Figure 8:
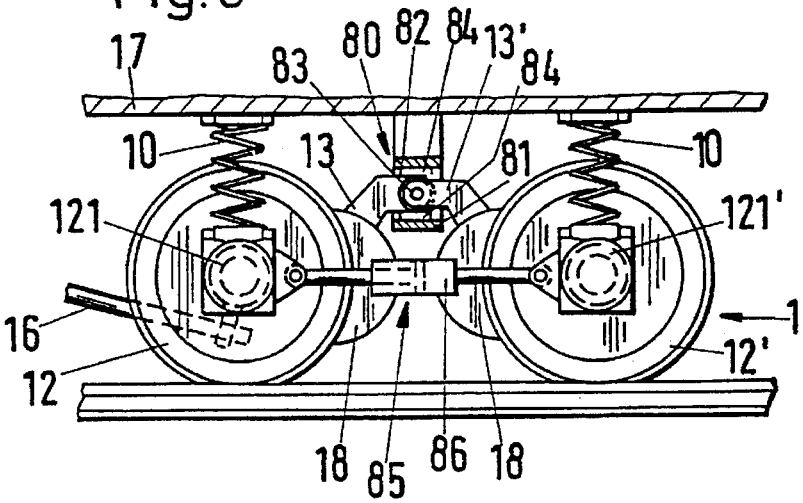
FIG. 8 is a side view of a part section of a truck in a further embodiment.

With the truck of FIG. 8 the wheelset units 12, 12' are connected to one another via a ball joint 83 and movably held in the transverse direction of the vehicle with a support part, in accordance with an illustration with the hitch 13, between two guide parts 81, 82 of a guide device 80 mounted on the vehicle body 17. The hitch 13 can, as illustrated, be slidingly guided via intermediate pieces 84 at the guide parts 81, 82. A spatially movable connection between the hitch 13 and the guide parts 81, 82 can also be achieved by corresponding resilient intermediate pieces 84 of a rubber-like material, with it being possible to use a correspondingly simpler hinge arrangement in place of the ball joint 83. The axle bearings 121, 121' are coupled by resetting elements 85 which each contain a hydraulic or pneumatic damping and/or positioning device 86. Via the positioning device 86 the adjustment of the wheelset units 12, 12' can be influenced. The positioning apparatus 86 can be connected to a non-illustrated control regulating apparatus, so that the adjustment of the wheelset units 12, 12' can also be controlled, regulated or blocked in accordance with preset values. Air springs or, as illustrated, coil springs can be provided as the spring elements 10.

Figure 9:
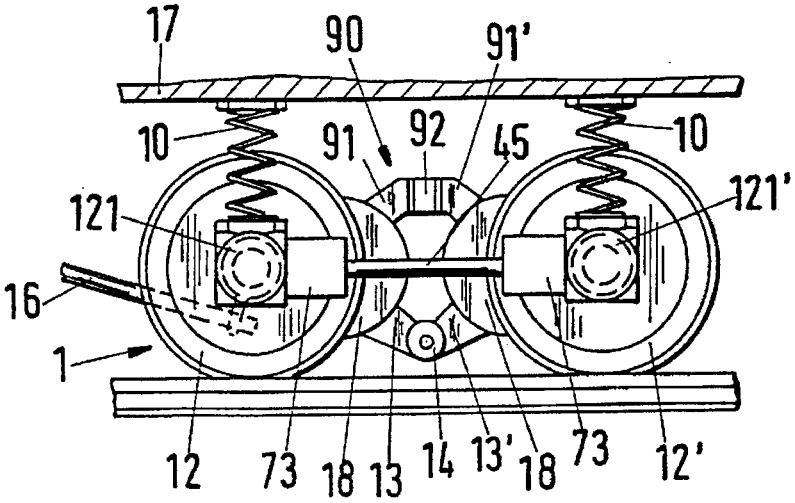
FIG. 9 is a side view of a further truck in a modified embodiment.

The truck of FIG. 9 contains a guide device 90 in the form of a self-supporting support arrangement independent from the vehicle body 17 which contains two support parts 91, 91' directed towards one another in the longitudinal direction of the vehicle. The support parts 91, 91' are formed on two projections each standing out from one of the drive motors 18, with the projections being mutually braced above the coupling arrangement 14 via a support element 92 of a rubber elastic material. Accordingly, the hitches 13, 13', which are intended for the transmission of the traction forces, are not loaded by vertical forces and are freely pivotally held in the transverse direction of the vehicle.

The rail vehicle has at least one truck 1 with two wheelsets 12, 12' which are hingedly connected together via a coupling arrangement. This truck 1 is formed as a frameless support arrangement and the vehicle body 17, is mounted on spring elements 10, and has at least one guide device or at least one pendulum 11 between the truck and the vehicle body 17. Through the omission of the complicated bogie frame the construction is greatly simplified and thus light and compact. The radially adjustable wheelset units 12, 12' can moreover be arranged with a small spacing from one another. The frameless truck 1 is thus particularly well suited for rail vehicles on rail networks which have small radii of curvature.

For constructional details and the designs of previous bogies in accordance with the prior art, reference is expressly made to the patent application EP-A1-0 420 801. In particular details of wheelset units, spring elements, and bearing arrangements are shown and described therein.

What is claimed is:

1. Rail vehicle comprising a vehicle body, at least one truck having first and second wheelset units each including a wheelset having two spaced-apart wheels mounted on a common axle and two axle bearings, a hinge arrangement connecting the wheelset units and causing pivotal movements between the wheelset units with respect to each other about a single, substantially upright axis when the truck travels along a curved track, means for the transmission of traction forces between the vehicle body and the wheelset units, the at least one truck defining a frameless support for the vehicle body including spring elements at the axle bearings of the wheelset units, a guide device arranged between the vehicle body and the truck including at least one guide part adapted to transmit bearing forces and supporting at least one of the wheelset units so that the at least one of the wheelset units is freely deflectable transversely relative to the vehicle body, and at least one adjustment element arranged between the wheelset units.

2. Rail vehicle in accordance with claim 1 wherein the hinge arrangement comprises a hinge connection coupling the wheelset units to one another for universal relative movement between them.

3. Rail vehicle in accordance with claim 1 wherein the guide device comprises first and second guide parts defining first and second pendulums arranged between the wheelset units and the vehicle body.

4. Rail vehicle in accordance with claim 3 including means for pivotally connecting the first and second pendulums to respective ones of the wheelset units of the truck and to the vehicle body, respectively.

5. Rail vehicle in accordance with claim 3 wherein said first and second pendulums have longitudinal axes and are arranged inclined to one another so that extensions of their axes intersect an ideal roll axis of the vehicle which extends in a direction of travel for the vehicle body and is located at approximately a portion of the vehicle body where passengers are located when said vehicle body is in use.

6. Rail vehicle in accordance with claim 1 wherein the guide part comprises a bracket projecting from the vehicle body for the transmission of the traction forces, and an articulated connection connecting the bracket to the at least one wheelset unit.

7. Rail vehicle in accordance with claim 6 including means hingedly connecting the bracket and permitting relative pivotal movements between the bracket and the vehicle body about an axis extending substantially in a longitudinal direction of the vehicle.

8. Rail vehicle in accordance with claim 1 wherein the hinge arrangement includes a support part attached to one of the wheelset units, and wherein the guide part is mounted on the vehicle body and has a guide track for the support part which permits movements of the support part on the guide track in a transverse direction of the vehicle.

9. Rail vehicle in accordance with claim 1 wherein the guide device comprises a support arrangement which is vertically displaced relative to the hinge arrangement and movable in a transverse direction of the vehicle, the support arrangement having first and second support portions each projecting from one of the wheelset units and bracing each other in a longitudinal direction of the vehicle.

10. Rail vehicle in accordance with claim 1 wherein at least one of the wheelset units comprises a drive unit.

11. Rail vehicle in accordance with claim 1 wherein the means for the transmission of traction forces comprises a pull-push bar arranged between the at least one truck and the vehicle body.

12. Rail vehicle in accordance with claim 1 wherein the spring elements comprise one of coil springs and air springs.

13. Rail vehicle comprising a vehicle body, at least one truck having first and second wheelset units each including a wheelset having two spaced-apart wheels mounted on a common axle and two axle bearings, a hinge arrangement connecting the wheelset units and permitting pivotal movements between the wheelset units, means for the transmission of traction forces between the vehicle body and the wheelset units, the at least one truck defining a frameless support for the vehicle body including spring elements at the axle bearings of the wheelset units, a guide device arranged between the vehicle body and the truck including at least one guide part adapted to transmit bearing forces and supporting at least one of the wheelset units so that the at least one of the wheelset units is freely deflectable transversely relative to the vehicle body, and at least one adjustment element arranged between the wheelset units, the guide part comprising a single pendulum, and means for pivotally connecting the guide part to the at least one wheelset unit and to the vehicle body.

14. Rail vehicle comprising a vehicle body, a truck forming a frameless support for the vehicle and including first and second wheelsets each defined by a mounting structure, wheels mounted on a common axle proximate respective ends thereof, and an axle bearing for each axle end; a spring element associated with each axle bearing supporting the vehicle body on the respective axle bearing; a hinge connection coupling the mounting structures of the wheelsets and permitting substantially unrestrained relative pivotal movements of the wheelsets with respect to each other about a substantially upright axis so that the wheelsets become angularly inclined relative to each other when the truck travels along a curve; a guiding part supporting at least one said wheelset for transmitting bearing forces in a manner permitting transverse deflections of the at least one wheelset relative to the vehicle body; and means connected to and disposed between the wheelsets of the truck and generating a force sufficient for pivotally moving the wheelsets about the hinge relative to each other from an angularly inclined to a parallel position after the truck has traveled along the curve.

15. A truck comprising first and second wheelset units for traveling along a track including curves, each wheelset unit having an axis, the axes of the units being normally parallel to each other, means including a hinge connection pivotally connecting the wheelset units to each other and permitting pivotal movements of the wheelset units about the hinge so that the axes of the wheelset units become inclined with respect to each other when the truck travels along a curve of the track, axle bearings for the wheelset units, a means arranged on each bearing for receiving a spring element for supporting a vehicle body, at least one guide device movably coupled to one of the wheelset units and adapted to be attached to the vehicle body, and at least one adjusting element arranged between and connected with the first and second wheelset units generating a force which is sufficient for moving the wheelset units from a position in which their axes are inclined to a position in which their axes are parallel.

16. An articulated rail car comprising first, second and third vehicle sections each having a vehicle body, the second section being disposed between the first and third sections and including a truck forming a frameless support for the second section with first and second wheelsets each defined by a common axle and wheels mounted on the axle proximate respective ends thereof, the axes being normally parallel to each other, and an axle bearing for each axle end; a spring element associated with each axle bearing supporting the vehicle body on the respective axle bearing; a hinge connection between the wheelsets permitting relative pivotal movements of the wheelsets with respect to each other between positions in which the axles are parallel and angularly inclined; a guiding part supporting at least one wheelset for transmitting bearing forces in a manner permitting transverse deflections of the at least one wheelset relative to the vehicle body; and means disposed between and connected with the wheelsets of the truck generating a force for moving the wheelsets relative to each other from the position in which the axles are angularly inclined to the position in which the axles are parallel.

* * * * *